United States Patent [19]

Hiramatsu

[11] Patent Number: 4,556,854

[45] Date of Patent: Dec. 3, 1985

[54] MICROWAVE WINDOW AND MATCHING STRUCTURE

[75] Inventor: Yukio Hiramatsu, Los Altos, Calif.

[73] Assignee: Litton Systems, Inc., Beverly Hills, Calif.

[21] Appl. No.: 625,987

[22] Filed: Jun. 29, 1984

[51] Int. Cl.[4] ..... H01P 1/08

[52] U.S. Cl. ..... 333/34; 333/230; 333/252

[58] Field of Search ..... 333/33, 34, 230, 252

[56] References Cited

U.S. PATENT DOCUMENTS 3,289,122 11/1966 Vural ..... 333/252

3,860,891 1/1975 Hiramatsu .

FOREIGN PATENT DOCUMENTS 559309 9/1977 U.S.S.R. ..... 333/252

*Primary Examiner*—Paul Gensler

*Attorney, Agent, or Firm*—Roy L. Brown

[57] ABSTRACT

A circular waveguide window between two rectangular wave-guides, having increased bandwidth and increased power handling capability. It uses particular window and an impedance matching structures whose dimensions are related in a particular way to the dimensions of the rectangular waveguides.

3 Claims, 13 Drawing Figures

MICROWAVE WINDOW AND MATCHING STRUCTURE

BACKGROUND OF THE INVENTION

1. Field of the Invention

This invention pertains to a window for transmitting microwave energy from one waveguide into another waveguide. More particularly, it pertains to a window for transmitting microwave frequency energy from one rectangular waveguide into another rectangular waveguide. Still more particularly, it pertains to a substantially circular microwave window for transmitting such microwave energy, together with microwave impedance matching structure.

2. Description of Related Art

Extensive development of new microwave tubes in recent years has produced higher output power and wider bandwidth requirements which exceed the limited capability of microwave windows of conventional design. Recent emphasis on millimeterwave tubes has added another difficulty in scaling conventional windows to higher frequencies where their dimensions become extremely small.

A window is needed because it frequently is desired to seal one wave guide pneumatically from the other waveguide. For example, one waveguide may be inside a microwave tube. Windows such as beryllia or alumina windows typically may be used. Beryllia is usually preferred, but because of difficulties in sealing beryllia to the metal walls of the wave guides, and the relative ease of sealing alumina to the wave guide metal walls, one might choose a window of alumina. Because of the higher dielectric constant of alumina, for a given transmission characteristic the alumina window will be smaller than the beryllia window.

It is desirable to explain the use of the window of this invention in connection with the transfer of microwave energy in the $TE_{10}$ mode wherein the electric field intensity distribution is essentially uniform across the short or "b" dimension of the rectangular waveguides and varies in sinusoidal function across the long or "a" dimension of the rectangular waveguides.

According to the prior art, one might use a rectangular window having the same dimensions as the waveguide and as thin as practicable. That is, thick enough to support the difference in gas pressures between the two waveguides and easily machineable. However, such a window has a very narrow transmission bandwidth compared to the transmission bandwidth of a rectangular waveguide in a $TE_{10}$ mode. Note also that a conventional thin window may be too thin to accommodate a reasonable pressure differential. Consequently, to use the widest bandwidth characteristics of the rectangular waveguide, one could not use such a window.

One might use a window such as that described in U.S. Pat. No. 3,860,891, entitled, "Microwave Waveguide Window Having the Same Cutoff Frequency as Adjoining Waveguide Section for an Increased Bandwidth" which issued Jan. 14, 1975 to Yukio Hiramatsu, the inventor herein. Such windows are typically about one half-wave length in thickness at some frequency in the middle of the passband of the window and of the waveguides, and they have matching transformer stubs 15 and 16 as shown, for example, in FIG. 6 of the patent. Such windows are particularly good when made of beryllia. They are also operable with alumina. However, although, as shown in FIG. 9 of the patent, the window 13 may have a diameter substantially equal to the short or "b" dimension of the waveguide for a particular frequency, in practice that rarely occurs. To obtain the desired bandwidth, the diameter is reduced, and as the dielectric constant of the window increases, the diameter of the window must further be decreased. Because alumina has a dielectric constant higher than beryllia, the diameter for alumina must, in the embodiment of the patent, be even smaller than that for beryllia. Consequently, an embodiment such as, for example, that of FIG. 17 of the patent must then be used to channel microwave energy into the region of the window.

Other means of focussing microwave energy might also be used. Such focussing also changes the bandwidth of the structure.

The window of the patent also may be used, as shown for example in FIG. 23 of the patent, to connect ridged waveguides.

SUMMARY OF THE INVENTION

The waveguide window of this invention extends the bandwidth and power-handling capability of waveguide windows beyond that of conventional windows. Also the new windows can easily be scaled to many frequency ranges including millimeter-wave frequencies.

The apparatus of this invention uses a circular disc window, preferably of alumina, having a diameter that is at least as large as, and substantially equal to, the short dimension of the larger of the two connected waveguides. A circular-disc window is chosen for its wide bandwidth even though its power handling capability is less than a rectangular window. The thickness of the window is chosen to be one half wave-length at a center frequency of the passband of the rectangular waveguides. When a non-ridged rectangular waveguide is to be matched to the window, alumina transformer matching stubs one quarter wave-length at that same center frequency extend outward from the surfaces of the window. Such a window has a slightly shorter bandwidth than the bandwidth of the adjacent rectangular waveguides in the $TE_{10}$ mode. Note, however, that the window area is positioned in and covers most of the area of high intensity of the electric field of the rectangular waveguide so that it is in position to conduct such field with a high efficiency. The impedance matching of this invention extends the bandwidth without substantially reducing the power transmitting capability of the window.

The apparatus contemplated by this invention is such a window matched by a two part impedance matcher to its adjacent waveguides. The juxtaposed waveguide parts have a positioned step or ramp in the part adjacent the waveguide to be matched and a trough in the part adjacent the window.

When matched to a rectangular waveguide of long dimension "a" and short dimension "b", the short dimension adjacent the window is increased to a dimension "b1". Because the electric field is of minimum intensity at the ends of the long dimension, and because the window is not adjacent the edges of the waveguide walls on the long dimension, the increase in the long dimension is optional.

The decrease in the short dimension to a dimension "$b_o$, in the direction away from the window, is a step or ramp in the waveguide. In the non-ridged waveguide, the step decreases the short or "b" dimension. The long or "a" dimension also optionally may be decreased. Because the electric field is substantially zero near the end of the long dimension of the waveguide, the impedance match is substantially insensitive to a small change in the long dimension "a".

In a ridged waveguide, the short dimension "b" of the wave guide is not decreased, but a step or ramp is placed on the ridges, thereby shortening the spacing from "b2" to "$b_o$" between the ridges.

In a window which matches a non-ridged waveguide, the relative height of the step or ramp compared to the diameter and length of the transformer stubs and the diameter of the window, and its position relative to the transformer stubs and to the window are important. The step is closer to the window than the outer end of the transformer stubs. The trough depth and width is also important. Both the step and the trough preferably extend along the entire length of the long dimension "a" of the waveguide. With the large alumina window, the matching stubs, and the matching step, the combination window of this invention efficiently transfers microwave energy in the $TE_{10}$ mode from one rectangular waveguide to another rectangular waveguide, and the waveguides may be of different sizes.

When using a window of this invention with a ridged rectangular waveguide, the matching step need only be on the ridge, for that is the region of maximum electric field intensity. It may, optionally also be on the other edges of the waveguide where the field intensity is lower. In such a waveguide, not only is the "b1" dimension of the trough important, but also the height of the ridge and the height of the step on the ridge is important. That is, the decreased separation "$b_o$" is significant.

Such window is particularly useful in transferring energy out of and into microwave tubes.

It is therefore an object of this invention to transfer microwave energy from one waveguide to another.

It is a more particular object of this invention to transfer energy in a $TE_{10}$ mode from one rectangular waveguide to another rectangular waveguide using a particular circular window made, preferably, of alumina.

It is also a particular object of this invention to carry microwave energy out of and into microwave tubes.

It is a specific object of this invention to provide a microwave window structure.

BRIEF DESCRIPTION OF THE DRAWING

Other objects will become apparent from the following description, taken together with the accompanying drawings, in which.

DESCRIPTION OF THE PREFERRED EMBODIMENTS

FIGS. 1–5 show a first embodiment of the invention wherein two non-ridged rectangular waveguides are connected by the window of this invention.

Figure 1:
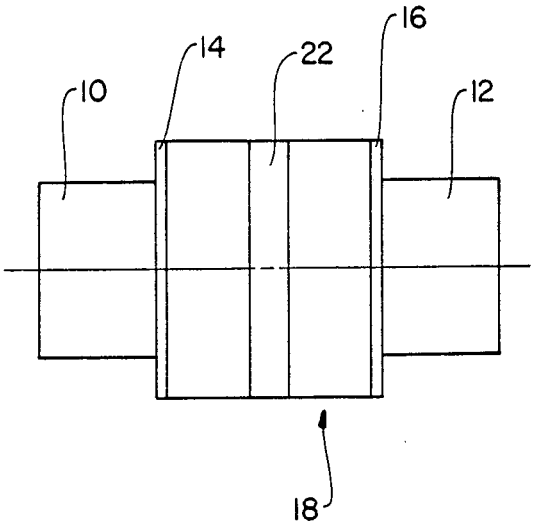
FIG. 1 is a profile view of a rectangular wave guide, with or without ridges, and with a window in place.
Figure 2:
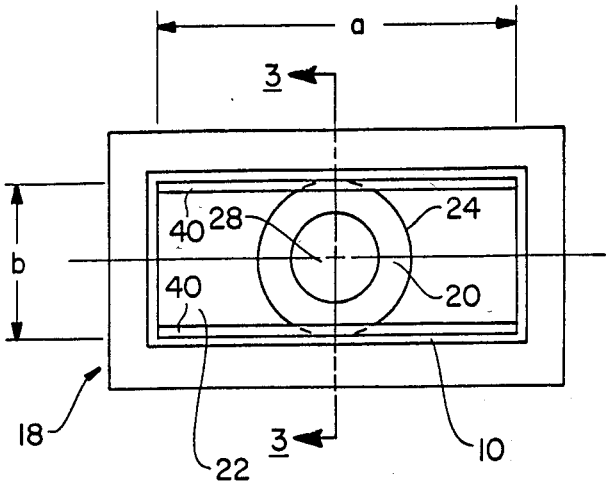
FIG. 2 is a view of FIG. 1, taken from the left, and without ridges in the waveguides.
Figure 3:
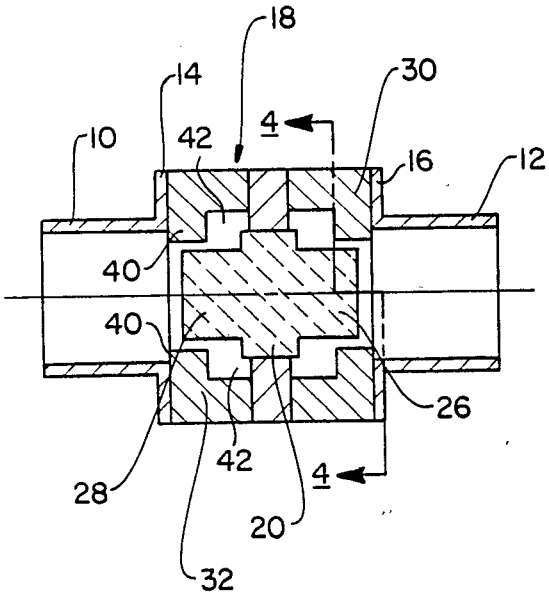
FIG. 3 is view, partly in section, taken at 3—3 in FIG. 2.
Figure 4:
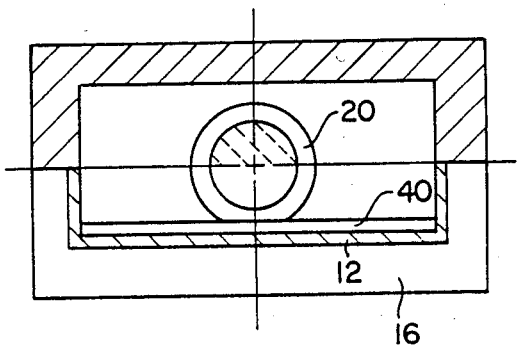
FIG. 4 is a view, partly in section, taken at 4—4 in FIG. 3.
Figure 5:
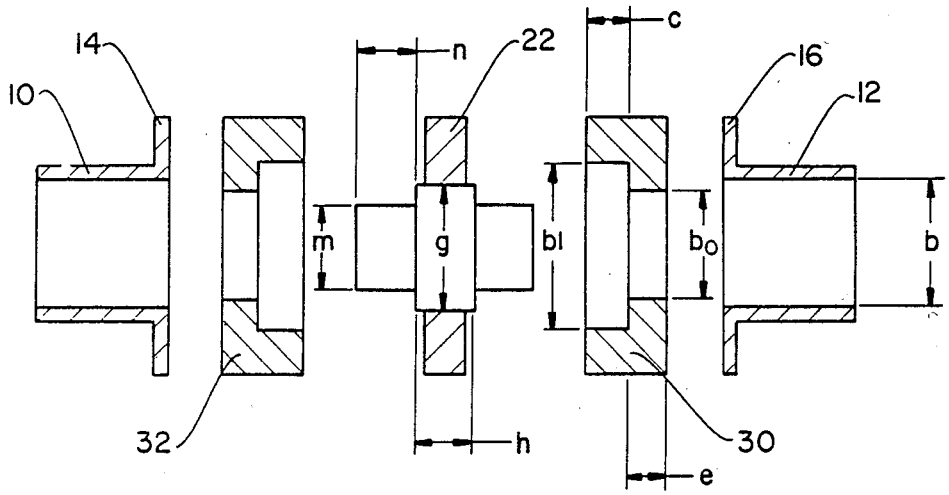
FIG. 5 is an exploded view of FIG. 3.

Two rectangular waveguides 10 and 12 are typically attached, as by brazing, through flanges 14,16 to a fixture 18 for supporting the window 20 of this invention. The internal dimensions of the waveguide, shown in FIG. 2, are designated "a" for the long dimension and "b" for the short dimension.

The window 20 is circular and has a diameter substantially equal to the short dimension "b" of the rectangular waveguide 12. It is supported by a rectangular, typically metal, plate 22 having an aperture 24 therein for receiving the window 20. The window 20 is preferably of alumina. It may, however, be of beryllia. Alumina is preferable because it has a higher dielectric constant to cause a larger percentage of the electric field to be transmitted and because it seals easier to the metal support structure 22. The window 20 is sealed to the support 22. The thickness of the window is approximately one half-wavelength at a center frequency of the passband of the rectangular waveguides 10 and 12. The matching stubs 26, 28 are a quarter-wavelength at the same frequency as the frequency for determining the thickness of the window 20. The stubs 26,28 are circular and extend outward from the opposing surfaces of the window 20. The stubs are preferably of the same material as the window 20 and may, if desired, be fabricataed integrally with the window 20.

The support 22 is clamped between two substantially identical rectangular spacing members 30 and 32 which are, typically, brazed to the support member 22 and to the flanges 14,16. The members 30 and 32 may differ slightly to accommodate different sized waveguides 10, 12.

It is first desirable to present a table of known dimensions of standard commercially available waveguides:

TABLE A

| Commercial Waveguide Designation | Frequency Range Gigahertz | "a" Inch | "b" Inch | "a/b" |
|---|---|---|---|---|
| WR-187 | 3.95–5.85 | 1.872 | 0.872 | 2.147 |
| WR-137 | 5.85–8.20 | 1.372 | 0.622 | 2.206 |
| WR-90 | 8.20–12.4 | 0.900 | 0.400 | 2.250 |
| WR-62 | 12.4–18.0 | 0.622 | 0.311 | 2.000 |
| WR-42 | 18.0–26.5 | 0.420 | 0.170 | 2.471 |
| WR-28 | 26.5–40.0 | 0.280 | 0.140 | 2.000 |
| WR-19 | 40.0–60.0 | 0.188 | 0.94 | 2.000 |

TABLE A-continued

| Commercial Waveguide Designation | Frequency Range Gigahertz | "a" Inch | "b" Inch | "a/b" |
|---|---|---|---|---|
| WR-12 | 60.0–90.0 | 0.122 | 0.061 | 2.000 |

Note in the above set of standard commercial waveguides, the ratio of "a/b" is not the same for every waveguide. For a given ratio of "a/b", one could determine empirically the optimum dimensions for the matching cavity used to match the window and matching stubs to the waveguide according to this invention. Then one could scale the dimensions "c", "b1", "e" and "$b_o$" (FIG. 5) proportional to "a".

In determining Table B, optimum dimensions were first obtained for coupling a window of this invention to waveguides which have "a"=1.372 and "a/b"=2.000, a non-standard waveguide. The dimensions for the second column were obtained experimentally, and the dimensions for the remaining columns were calculated for "a/b"=2,000 by making the dimensions proportional to "a".

TABLE B

| | Dimension inch | | | | | | | |
|---|---|---|---|---|---|---|---|---|
| "a" | 1.872 | 1.372 | 0.900 | 0.622 | 0.420 | 0.280 | 0.188 | 0.122 |
| "c" | 0.259 | 0.190 | 0.125 | 0.086 | 0.058 | 0.039 | 0.026 | 0.017 |
| "b1" | 1.119 | 0.820 | 0.538 | 0.372 | 0.251 | 0.167 | 0.112 | 0.073 |
| "e" | 0.341 | 0.250 | 0.164 | 0.113 | 0.077 | 0.051 | 0.034 | 0.022 |
| "$b_o$" | 0.880 | 0.645 | 0.423 | 0.292 | 0.197 | 0.132 | 0.088 | 0.057 |
| "g" | 0.846 | 0.620 | 0.407 | 0.281 | 0.190 | 0.127 | 0.085 | 0.055 |
| "h" | 0.437 | 0.320 | 0.210 | 0.145 | 0.098 | 0.065 | 0.044 | 0.028 |
| "m" | 0.619 | 0.454 | 0.298 | 0.206 | 0.139 | 0.093 | 0.062 | 0.040 |
| "n" | 0.409 | 0.300 | 0.197 | 0.136 | 0.092 | 0.061 | 0.041 | 0.027 |

However, with the ratios of "a/b" for some of the standard waveguides differing from 2.000, the second approximation to an optimum coupler for those waveguides not having "a/b"=2.000 is to start with the above calculated dimensions, then to modify the dimensions, particularly "c","b1""e" and "$b_o$" to improve the VSWR over the bandwidth of the standard waveguide. For those standard waveguides of Table A not having "a/b"=2.000, "c" and "e" were left the same as in table B, but the height of the step 40, $(b1-b_o)/2$, and the depth of the trough 42, $(b1-b_o)/2$ are modified by changing "b1" and "$b_o$". As the ratio "a/b" increased, both "b1" and "$b_o$" were decreased. However, the decrease in "b1" and "$b_o$" were not exactly linearly related to "a/b", and the dimensions determined experimentally are recited in Table C below.

TABLE C

| | Dimension inch | | | |
|---|---|---|---|---|
| "a" | 1.872 | 1.372 | 0.900 | 0.420 |
| "c" | 0.259 | 0.190 | 0.125 | 0.058 |
| "b1" | 1.051 | 0.760 | 0.495 | 0.220 |
| "e" | 0.341 | 0.250 | 0.164 | 0.077 |
| "$b_o$" | 0.860 | 0.620 | 0.403 | 0.184 |
| "g" | 0.846 | 0.620 | 0.407 | 0.190 |
| "h" | 0.437 | 0.320 | 0.210 | 0.098 |
| "m" | 0.619 | 0.454 | 0.298 | 0.139 |
| "n" | 0.409 | 0.300 | 0.197 | 0.092 |

Note that only "b1" and "$b_o$" have been modified.

When, however, the coupler for the Ku band, having "a/b"=2.000 was built, it was found that it could further be modified to give it additional bandwidth, and the modifications are as follows.

TABLE D

| | |
|---|---|
| "a" | 0.622 |
| "c" | 0.113 |
| "b1" | 0.335 |
| "e" | 0.145 |
| "$b_o$" | 0.305 |

TABLE D-continued

| | |
|---|---|
| "g" | 0.281 |
| "h" | 0.145 |
| "m" | 0.206 |
| "n" | 0.136 |

Figure 6:
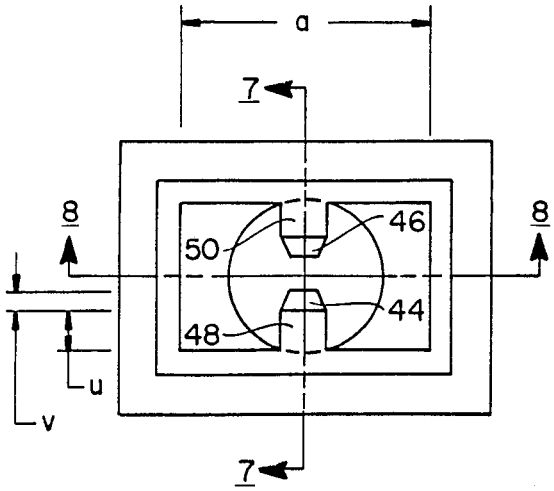
FIG. 6 is a view of FIG. 1, taken from the left and with a double ridged waveguide.
Figure 7:
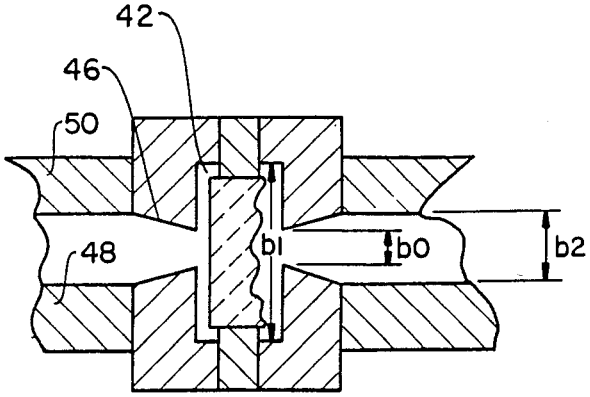
FIG. 7 is a view, partly in section, taken at 7—7 in FIG. 6.
Figure 8:
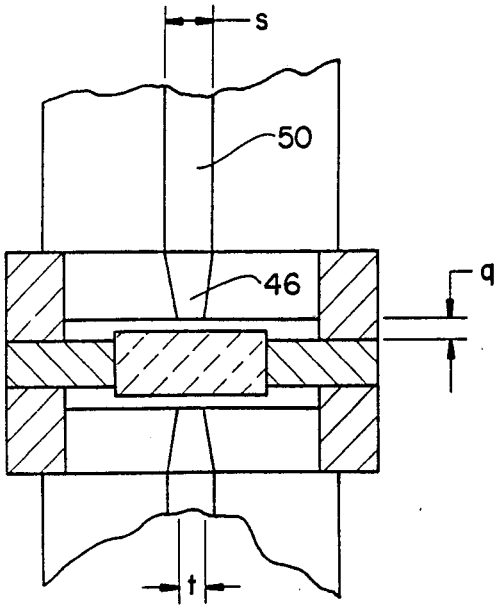
FIG. 8 is a view, partly in section, taken at 8—8 in FIG. 6.

The coupler of this invention for coupling the window to a ridged waveguide and particularly a double ridged waveguide, is shown in FIGS. 6 through 8. Instead of having the step 40 along the entire length of the "a" dimension of a rectangular waveguide as in FIGS. 1–5, the FIGS. 6–8 show ramps 44,46 mounted upon the top of the ridges 48,50 of the waveguide, thereby diminishing the spacing "$b_o$" between the ridges. The trough 42, having a "b" dimension of "b1" remains adjacent the window as in the non-ridged coupler. However, the quarter wave matching stubs of FIGS. 1–5 are not needed nor used on the window.

The following dimensions are typical for the window and coupler used to couple a double ridged wave to the window.

TABLE E

| | |
|---|---|
| "b" | 0.506 |
| "b1" | 0.306 |
| "$b_o$" | 0.184 |
| "b2" | 0.562 |
| "o" | 1.090 |
| "p" | 0.562 |
| "q" | 0.036 |
| "r" | 0.256 |
| "s" | 0.272 |
| "t" | 0.233 |
| "u" | 0.146 |
| "v" | 0.015 |

Thus, the broadband circular alumina window and associated impedance matcher of this invention has the following novel features.

1. The window has a diameter substantially equal to the narrow or "b" dimension of the rectangular or ridged waveguide to which it is matched.

2. The rectangular waveguide impedance matcher between the window and the adjacent rectangular or ridged waveguide is itself made of two short or partial juxtaposed waveguides. The first part adjacent the window has a "b" dimension "b1" that is greater than the "b" dimension of the waveguide to which it is matched. The first part is juxtaposed with a second part adjacent the waveguide that it is matching, such second part having a "b" dimension "$b_o$" that is less than the "b" dimension of the waveguide to which it is matched. In a non-ridged waveguide, the dimension "$b_o$" is less than "b". In the ridged waveguide, the ridge separation "$b_o$" of the second part is less than the ridge separation "b2" of the waveguide to which it is matched.

Figure 9:
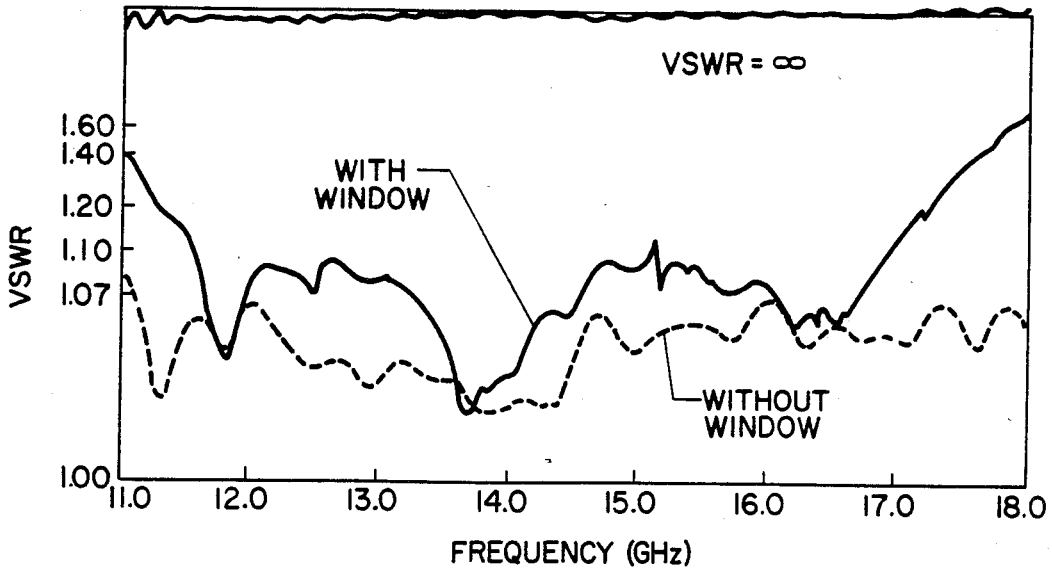
FIG. 9 is a graph of measured voltage-standing-wave-ratio (VSWR) of a typical rectangular waveguide according to the invention over a frequency range of 11.0 to 18.0 gigahertz.

FIG. 9 is a graph of measured voltage-standing-wave-ratio (VSWR) of a typical non-ridged rectangular wave guide in which the dashed graph represent the performance without the window and impedance matcher of this invention, and the solid graph represents the performance with the window and impedance matcher of this invention over a frequency range of 11.0 to 18.0 gigahertz.

Figure 10:
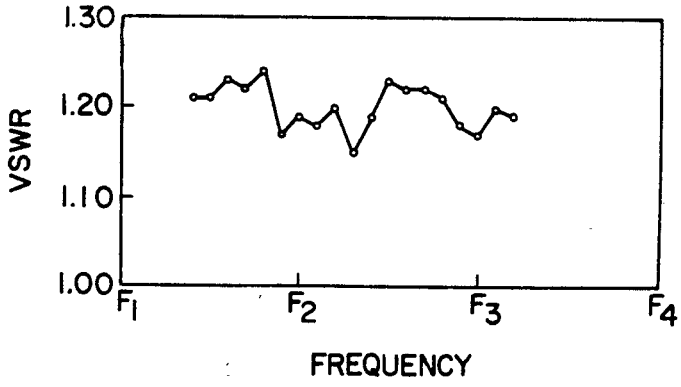
FIG. 10 is a graph of measured VSWR of a typical rectangular waveguide, according to the invention, at millimeter-wave frequencies.

FIG. 10 is a graph of measured VSWR of a typical non-ridged rectangular wave guide at millimeter-wave frequencies using the window and impedance matcher of this invention.

Figure 11:
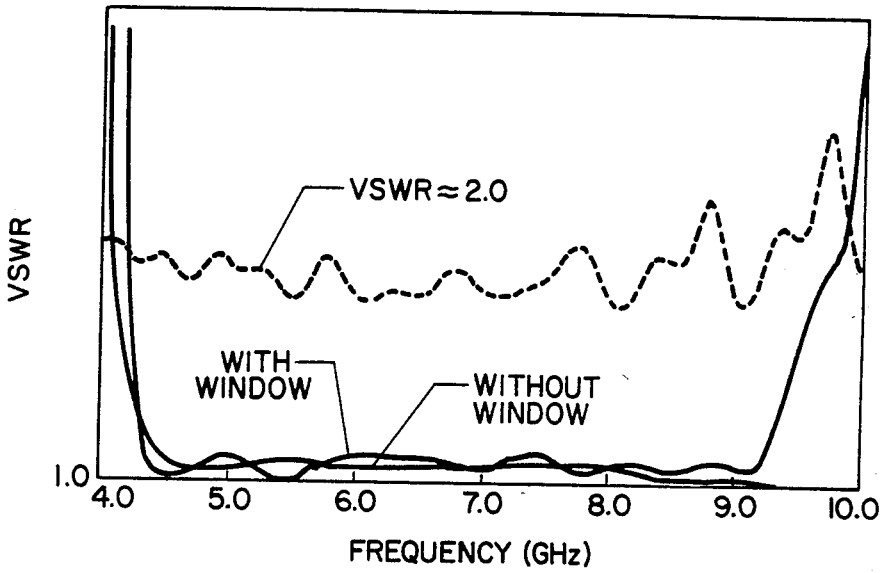
FIG. 11 is a graph of measured VSWR of a typical rectangular ridged waveguide, according to the invention, over a frequency range of 4.0 to 10.0 gighertz.

FIG. 11 is a graph of measured VSWR of a typical rectangular ridged wave guide showing performance both with and without the window and impedance matcher of this invention. The vertical scale has not been normalized on this graph, but the dashed line represents a VSWR of approximately 2.0.

Figure 12:
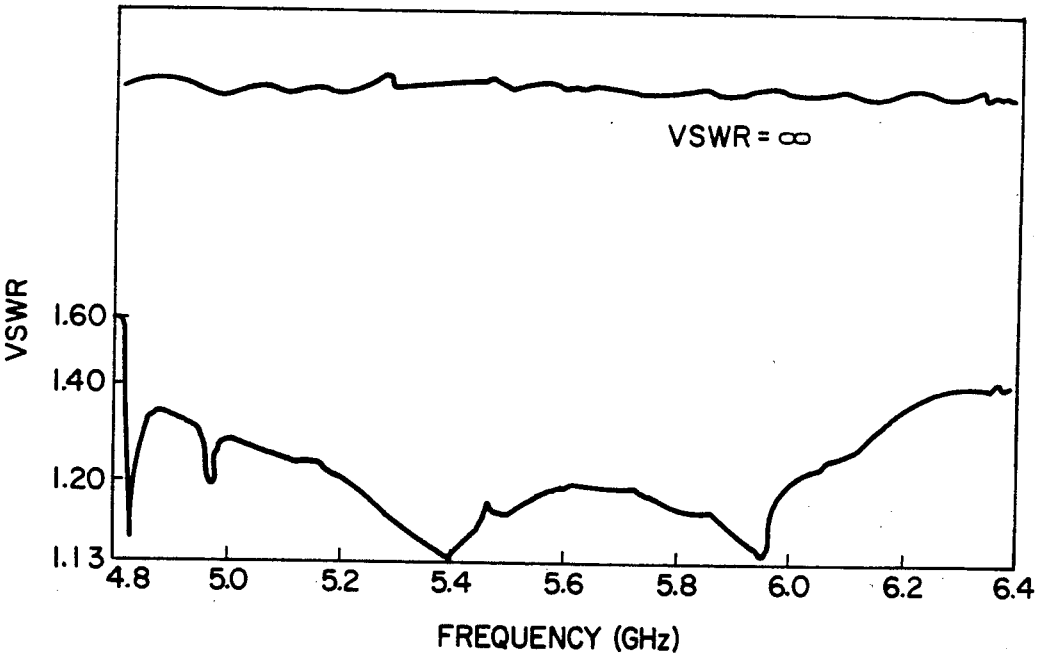
FIG. 12 is a graph of measured VSWR of two typical rectangular waveguides of different sizes, with a window therebetween according to the invention, over a frequency range of 4.8 to 6.4 gigahertz.

FIG. 12 is a graph of measured VSWR of two typical rectangular wave guides of different sizes, with a window and impedance matcher of the invention therebetween, over a frequency range of 4.8 to 6.4 gigahertz.

Figure 13:
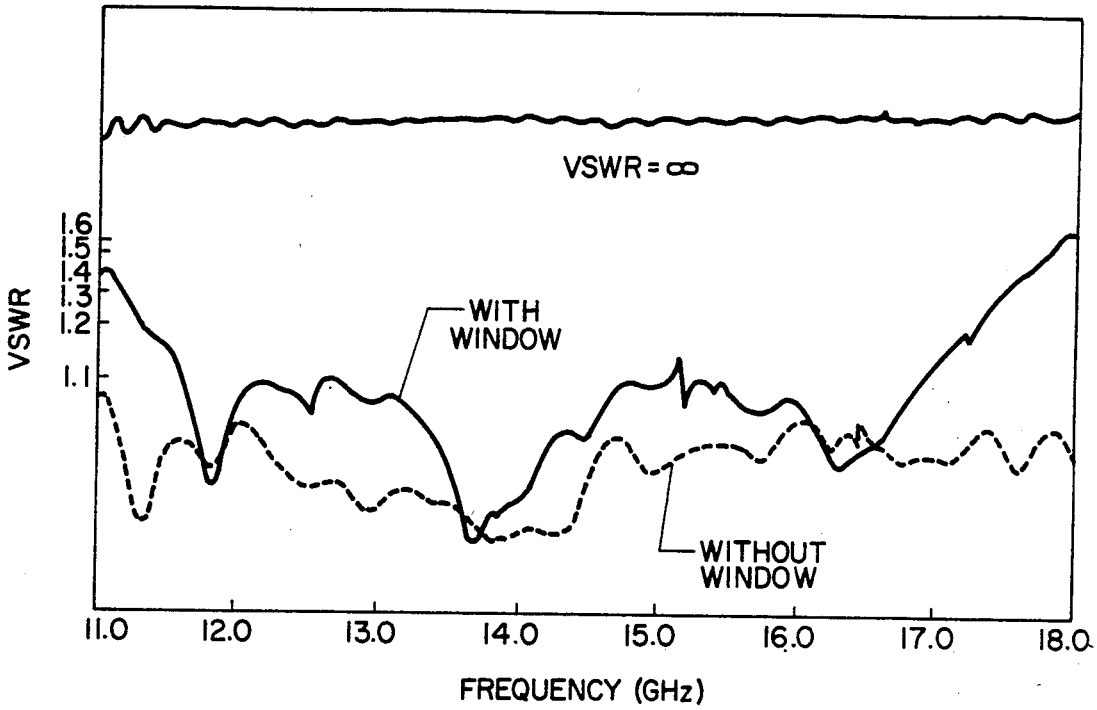
FIG. 13 is a graph of measured VSWR of two typical rectangular waveguides of different sizes, with a window therebetween according to the invention, over a frequency range of 11.0 to 18.0 gigahertz.

FIG. 13 is a graph of measured VSWR of two typical rectangular wave guides of different sizes, with a window and impedance matcher of this invention therebetween, over a frequency range of 11.0 to 18.0 gigahertz.

It is evident from the experimental curves of FIGS. 9–13 that the window and impedance matching apparatus of this invention produces a lower VSWR over a broader frequency band than prior art apparatus.

I claim:

1. In the structure of two rectangular waveguides chosen from the class consisting of ridged or unridged waveguides, each having a long dimension "a" and a short dimension "b", a circular alumina window positioned between said waveguides to carry microwave energy therebetween, said window being positioned substantially symmetrically at the center of said long and short dimensions, and an impedance matching structure for matching said window to said rectangular waveguides, said window and impedance matching structure being characterized by:

said window having substantially the same "b" dimension as the "b" dimension of the larger of said waveguides;

each said impedance matching structure having a first rectangular waveguide part adjacent said window with its "b" dimension "b1" greater than the "b" dimension of the waveguide to which it is matched;

each of said first rectangular wave guide parts juxtaposed with a second waveguide part of identical type to the said waveguide to which it is matched and having a minimum "b" dimension "$b_o$" that is less than the minimum dimension, in the "b" direction, of such waveguide to which it is matched.

2. Apparatus as recited in claim 1 in which said waveguides are all unridged rectangular waveguides, said "b" dimension is the short dimension of said waveguide to be matched and the diameter of said window, and said dimensions "b1" and "$b_o$" are greater and lesser than "b", respectively.

3. Apparatus as recited in claim 1 in which said wave guides to be matched and said second wave guide parts are ridged waveguides, "b" is the dimension of the unridged portion of said waveguide to be matched and the diameter of said window, "b2" is the separation between the ridges of said waveguide to be matched, "$b_o$" is the separation of the ridges of said second part and is less than "b2", and "b1" is greater than "b".

* * * * *